US007651417B1

(12) United States Patent
Sims

(10) Patent No.: US 7,651,417 B1
(45) Date of Patent: Jan. 26, 2010

(54) ADJUSTABLE PITCHING TARGET

(75) Inventor: Christopher Thomas Sims, Lawrenceville, GA (US)

(73) Assignee: Christopher T. Sims, Lawrenceville, GA (US)

( * ) Notice: Subject to any disclaimer, the term of this patent is extended or adjusted under 35 U.S.C. 154(b) by 137 days.

(21) Appl. No.: 11/986,694

(22) Filed: Nov. 26, 2007

Related U.S. Application Data

(60) Provisional application No. 60/867,294, filed on Nov. 27, 2006.

(51) Int. Cl.
*A63B 69/00* (2006.01)

(52) U.S. Cl. ..... 473/454; 482/15

(58) Field of Classification Search ..... 473/451, 473/432, 417, 453, 454, 468, 474, 564; 482/15, 482/148

See application file for complete search history.

(56) References Cited

U.S. PATENT DOCUMENTS

| | | | | |
|---|---|---|---|---|
| 3,475,026 | A * | 10/1969 | Cooper | 473/430 |
| 3,948,517 | A * | 4/1976 | Feiler | 473/429 |
| 4,208,050 | A * | 6/1980 | Perrine et al. | 482/148 |
| 4,657,250 | A | 4/1987 | Newland et al. | |
| 5,435,545 | A * | 7/1995 | Marotta | 473/417 |
| 5,634,856 | A * | 6/1997 | Rainey | 473/234 |
| 2004/0127308 | A1 * | 7/2004 | Swanson | 473/454 |

OTHER PUBLICATIONS

Internet website picture—Easton Strike Zone Pitching Target.

* cited by examiner

*Primary Examiner*—Gene Kim
*Assistant Examiner*—M Chambers

(57) ABSTRACT

One embodiment of an adjustable pitching target includes a base which secures a central target stand which contains a plurality of target holders and flexible targets that create a frontal, visual, strike zone at which the pitcher throws the ball and which yields a physical, visual, reaction as the pitched ball encounters and passes through the visual strike zone's targets.

2 Claims, 3 Drawing Sheets

ADJUSTABLE PITCHING TARGET

This application claims the benefit of provisional patent application Ser. No. 60/867,294, filed Nov. 27, 2006, which is incorporated herein by reference.

FIELD OF INVENTION

This invention relates to baseball and softball practice equipment, more particularly to an apparatus for assisting pitchers in throwing a ball to a desired location.

BACKGROUND

The ability to accurately throw a ball is important in many sports, but it is especially important in baseball and softball where a pitcher attempts to throw the ball past the batter. Pitches are judged to be "balls" or "strikes" in reference to a strike zone that includes both horizontal and vertical dimensions. The horizontal dimension of the strike zone is the width of home plate over which a pitch is thrown. Pitches thrown wide of the plate are out of the strike zone and are called "balls" whereas pitches that pass over the plate are within the horizontal strike zone. The vertical dimensions of the strike zone, officially defined as above the knees and below the shoulders of the batter, varies with the height of the batter. The strike zone's dimensions may also vary a little bit depending on the person calling the balls and strikes. Accurate pitching is a difficult skill to master, however, and requires a lot of practice. Good pitching practice not only entails throwing the ball into the strike zone, but learning to throw the ball to particular locations within the strike zone. An effective pitcher has sufficient control to throw pitches at the outer edges of the strike zone, known as "painting the corners" of the plate. A pitcher typically wants to avoid throwing the pitch right down the center of the strike zone, for a batter easily hits those pitches. Thus, one of the most important aspects of pitching is learning to hit the desired areas of the strike zone where that pitch will be called a "strike", but will be very hard to hit. For example, a pitcher may desire to throw a pitch low and toward the outer corner of the strike zone in an effort to get the pitch called a "strike" while making the pitch very difficult for the batter to hit well. To learn to throw that type of pitch requires the pitcher practice throwing to the various desired locations and to be aware of where the pitch passes through the strike zone over the plate. This practice allows the pitcher to develop the coordination and skill necessary to locate the pitch in the desired part of the strike zone.

It is sometimes difficult, however, for a pitcher to determine exactly where a pitch crosses the plate, and to determine the location of a pitch compared with other previously thrown pitches to achieve consistency. Whether due to the "break", or curve, of a pitch or due to the pitcher's follow-through, it may be difficult for the pitcher to determine the particular location of the pitch with reference to the plate. Thus, a pitcher typically relies on someone else, such as a catcher or an umpire, who stand close behind the plate to help the pitcher determine the particular location of the pitch with reference to the strike zone when it crosses the plate. Often, however, there may not be someone available to help the pitcher "call" the location of the pitches. Most teams have more pitchers than catchers, so there is a limited number of people available to help. Similarly, pitchers do not have an unlimited number of people who are both competent and willing to be an umpire. Furthermore, pitches may not be called consistently between the various umpires, catchers and coaches who may attempt to help and this may cause more confusion for the pitcher. In addition, some pitchers may choose to practice in private. Thus, although pitchers must practice often to develop their pitching skills, many pitchers find it difficult to practice as often as they would like due to the inability to have their pitches called with consistency and competence.

Various pitching targets have been developed over the years to assist pitchers in practicing their pitching, without the assistance of a catcher or an umpire to catch and/or call the pitches. But those devices have fallen short of providing the vital information the pitcher needs to know about the pitch he just threw: did the pitch hit the strike zone and where did it hit in the strike zone? Many of these prior art targets, such as Easton's Strike Zone, simply provide a target hole through which to throw the ball. Such devices fail to provide a pitcher with adequate feedback as to where the ball passed through the strike zone and don't provide the opportunity to adjust the strike zone to the size the pitcher will most likely be facing. Other prior art devices provide a target for the pitcher to throw at which comprise a target that is hung up on something (such as U.S. Patent Publication No. 20040127308 to Swanson, entitled "Padded Leather Pitching Target). Those devices tend to be bulky and require something to hang them from, making them difficult to use indoors or on undeveloped practice areas. They are not readily adjustable to provide different sized strike zones.

The pitching targets available currently are directed more toward collecting and/or returning the ball to the pitcher than assisting the pitcher in practicing pitch location. As mentioned above, a pitcher needs to learn how to throw pitches in the areas of the strike zone that are hard for a batter to hit, such as the outer portions of the strike zone, and not simply learn to throw pitches directly down the center of the strike zone. Most prior art pitching targets simply consist of some netting with a hole through which a pitcher attempts to throw the ball. Those devices lead pitchers to concern themselves more with getting the ball through the hole, than with placing the ball within the strike zone at locations that are difficult for the batter to hit well. In fact, these prior art devices actually strengthen the idea to just throw the ball directly down the center of the strike zone, which makes hitting rather easy for the batter. These target holes are typically provided in netting that is supported at the outside edges, which provides a large open target area in the middle. This ultimately trains the pitcher to pitch the ball right over the plate. That is not the location a successful pitcher wants to throw the ball when trying to get a batter out.

Other targets, such as that shown in U.S. Pat. No. 4,657,250 to Newland et al., are very complex and require substantial set up. Furthermore, these devices do not have an easily adjusted strike zone, are expensive, have targets supported from the outside edges that may effect and/or alter the flight of the pitch which will impact what the pitcher needs to know—did my pitch hit and where did it hit the strike zone?

SUMMARY

In an exemplary embodiment, an adjustable pitching target provides a visual strike zone and instant visual feedback as to the location of a ball as it passes through an established strike zone. A vertically extending central target stand supports a plurality of horizontally extending spaced apart targets that extend from the sides of the central target stand to define outer portions of a strike zone. In an exemplary embodiment, the targets are resilient sleeves of polyethylene foam (a flexible foam that bends easily under pressure but returns to its original shape immediately, see pool toys and other products made of polyethylene foam) that are removeably coupled to horizontally extending target holders. The target holders may comprise support members that extend through the central target stand so as to provide target support portions on each side of the central target stand. The targets may comprise flexibly resilient sleeves/covers that are slid over the outer portions of the target holders. A plurality of target holders are providing, in a spaced-apart parallel manner to create a visual strike zone, support for the targets which the pitcher attempts to hit with his pitches. When the ball is thrown and strikes a target area, the flexible targets for that area flap, due to the target material being made of a flexible polyethylene foam, to provide a visual indicator to the pitcher of the location of the pitch. In an exemplary embodiment, a resilient and flexible target flaps, when hit by a pitched ball, and returns, as polyethylene foam does, to its original shape and position. In this manner, a pitcher can see where the pitched ball actually hit the strike zone. The targets are immediately ready for the next pitch. The targets are positioned on the right and left sides of the central target stand to reinforce to the pitcher that he should throw pitches to the edges of the strike zone. This adjustable pitching target instructs the pitcher to avoid the central target stand in the middle and hit the targets to either side. This strengthens the pitcher's ability to hit those targeted areas in a game. If the pitcher hits the central target stand, none of the targets move and the ball bounces off the stand with a dull thud.

DRAWINGS

Reference Numerals

Figures 1A, 1B:
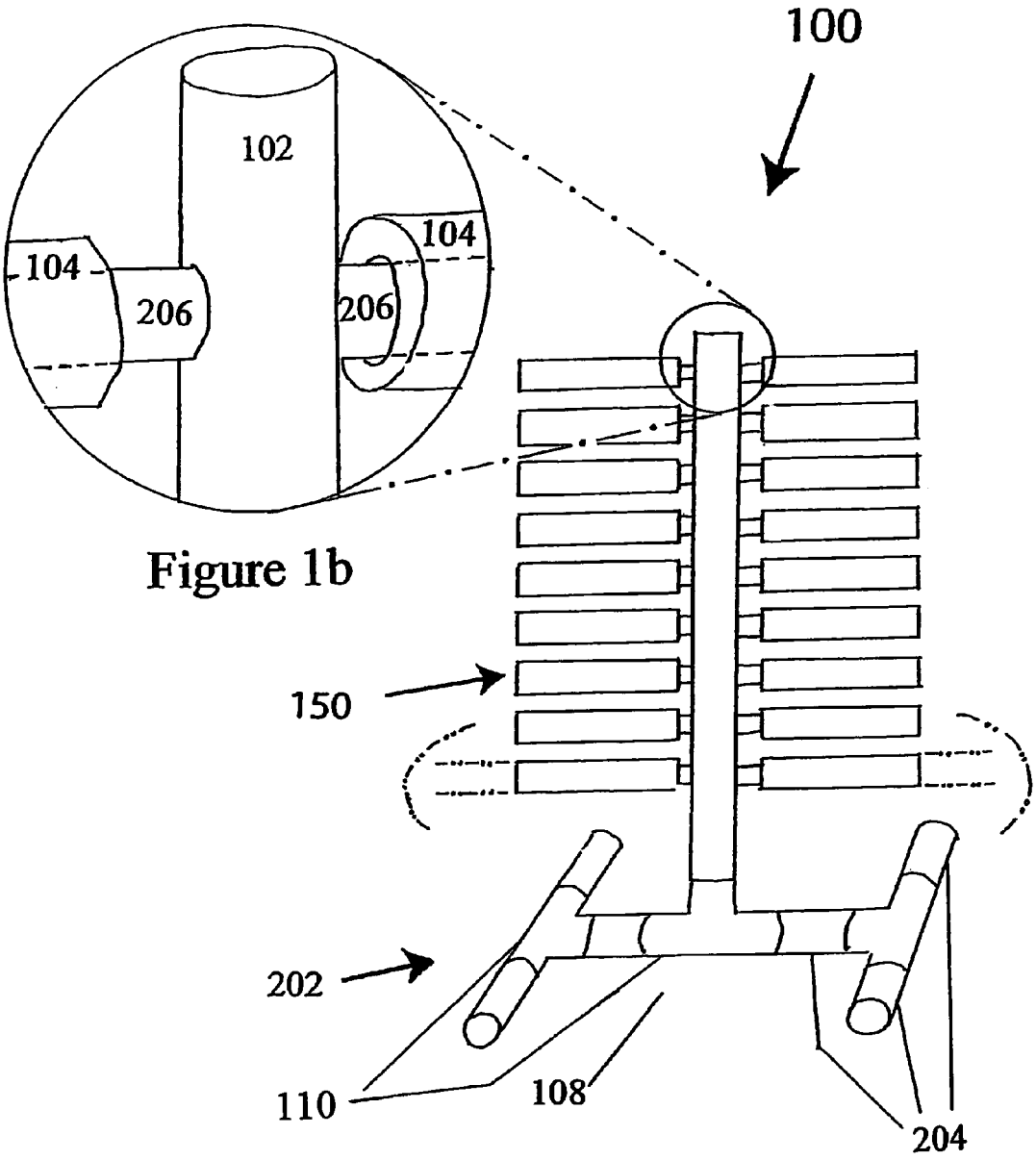
FIG. 1*a* shows a perspective view of an adjustable pitching target in accordance with a first exemplary embodiment of the invention.
FIG. 1*b* shows an enlarged view of a portion of FIG. 1*a* to show the target and target holder and how they are attached in more detail.

100 adjustable pitching target
102 central target stand
104 flexible target
104L flexible target—lower example
108 crossbar
110 "T" piece of PVC pipe
150 target
202 base
204 base member(s)
206 target holder
304 bore hole
11020 visual strike zone

DESCRIPTION

As required, exemplary embodiments of the present invention are disclosed herein. These embodiments are meant to be examples of various ways of implementing the invention and it will be understood that the invention may be embodied in alternative forms. The figures are not to scale and some features may be exaggerated or minimized to show details of particular elements, while related elements may have been eliminated to prevent obscuring novel aspects. Therefore, specific structural and functional details disclosed herein are not to be interpreted as limiting, but merely as a basis for teaching one skilled in the art to variously employ the present invention.

Figure 2:
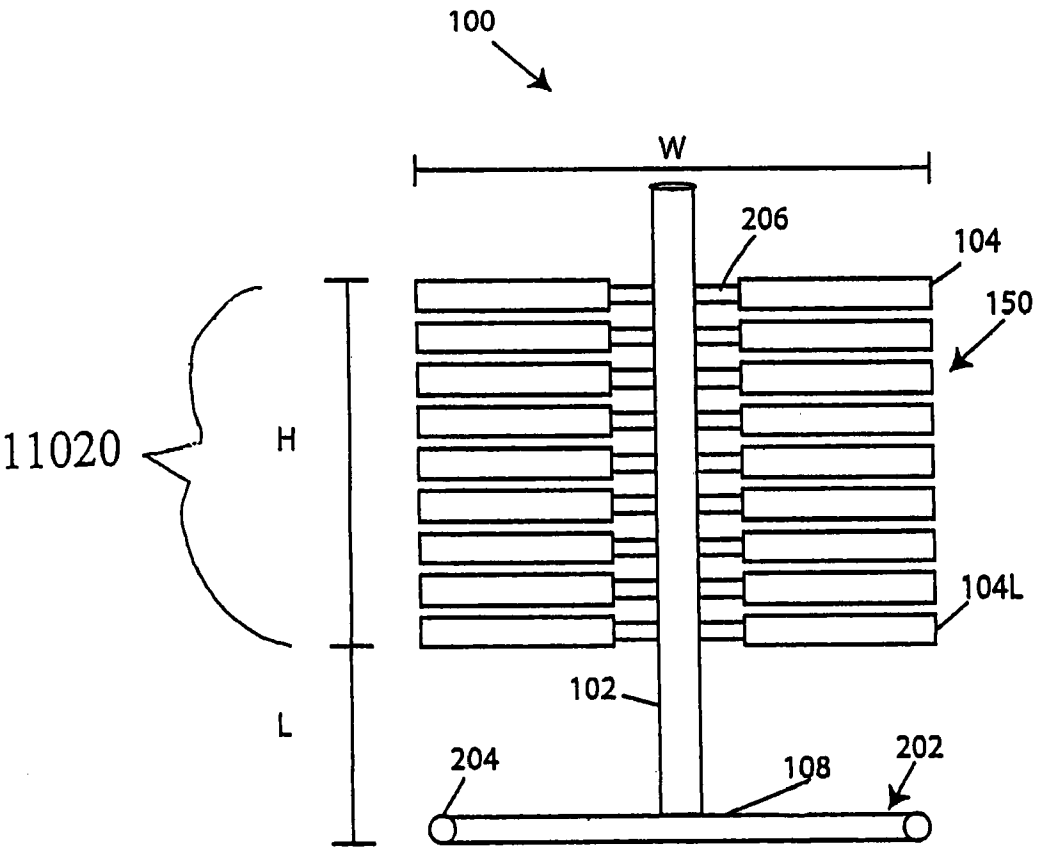
FIG. 2 shows a perspective view of an adjustable pitching target with height (H), width (W) and area below the strike zone (L) detailed.

Turning to the figures wherein like numbers represent like elements throughout the views, FIG. 1*a* shows an adjustable pitching target 100. The adjustable pitching target 100 includes a central target stand 102 and a plurality of targets 150 that together define a visual strike zone 11020 (see FIG. 2) against which a pitcher throws a ball. The adjustable pitching target 100 includes a base 202 comprising a plurality of interconnected base members 204 that form an elongated "H" shape (see FIG. 1*a*). The vertically extending central target stand 102 extends upwardly from the base 202 and provides means for removeably coupling target holders 206 as explained in more detail below. The central target stand 102 and targets 150 define an adjustable visual strike zone 11020 (see FIG. 2) having a height H and a width W. The visual strike zone 11020 is located a predetermined distance, height L, above the base and ground. As discussed in more detail below, the height and width of the visual strike zone 11020 as well as its location from the ground can be easily adjusted.

In the exemplary embodiment shown in FIG. 1*a*, the base members 204 are in the form of PVC pipe that are connected together in the generally accepted and usual manner that PVC pipe is connected together, using predetermined lengths and diameters of straight pieces of pipe and connecting "T" pieces of PVC pipe 110. But any suitable material, such as wood, could be used. In the exemplary embodiment shown in FIG. 1*a*, the base 202 is formed in the shape of the capital letter "H" with a crossbar 108 being located closer to the top of the capital letter "H" to provide stability when a ball strikes the adjustable pitching target 100. The top of the letter positioned respectively as the front of the base 202. The base 202 may use predetermined lengths of straight pieces of pipe for the front and rear of the base 202 and for the pieces used to form the crossbar 108 of the "H" configuration, which supports a central target stand 102.

The predetermined lengths of straight pieces of pipe are connected together using a "T" piece of PVC pipe 110. The "T" piece of PVC pipe 110 forms the middle of the crossbar 108, of the "H" configuration, and is oriented so that its central hole extends upward, perpendicular to the level plane of the base 202, to provide a receiving aperture for receiving and securing a lower end of the central target stand 102.

Figure 3:
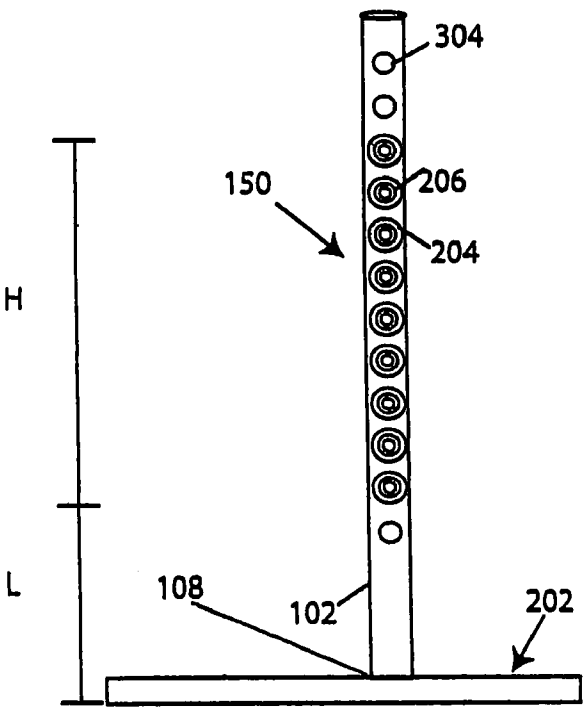
FIG. 3 shows a perspective view of an adjustable pitching target from the side.

The central target stand 102, is removeably coupled to the crossbar 108 of the base 202 so that it can be removed and thereby the apparatus becomes more compact for transporting or storing, and is easily reinserted into the crossbar 108 for the next use. For example, a lower end of the central target stand 102 can be inserted into the receiving hole of the crossbar 108 when in use and then easily removed when storing the adjustable pitching target 100 or transporting it to other locations for practice. As shown in FIG. 3, the central target stand 102, which may also be made of a predetermined length of PVC pipe, may have a plurality of spaced-apart apertures/holes on opposing sides that are aligned to define a bore hole 304 for receiving target holders 206 therethrough. As seen in FIG. 3, the target holders 206 may be inserted through the receiving bore holes 304 and positioned so that the middle of the target holder 206 is aligned with the axis of the central target stand 102 and the ends of the target holder 206 extend out through the central target stand 102 and provide a support for the flexible targets 104 to be placed on. Flexible targets 104, once positioned on the target holder 206, create a target 150 and extend outward horizontally to create the left and right sides of the visual strike zone 11020.

Figure 4:
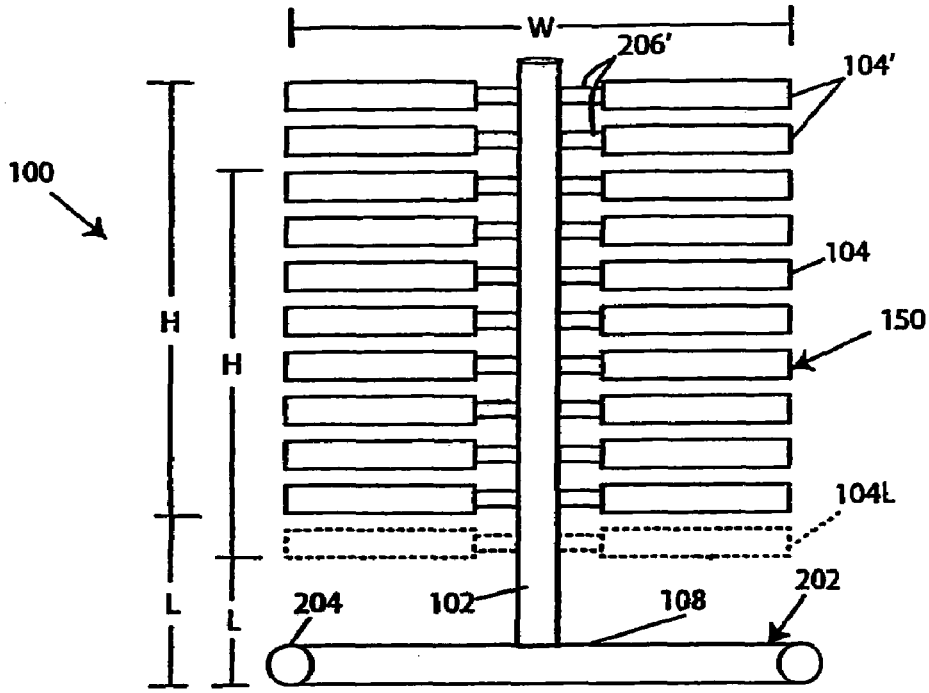
FIG. 4 shows a perspective view of an adjustable pitching target with changes in the height (H) and lower area (L) of the strike zone, due to adding lower targets, detailed.

A plurality of bore holes 304 may be provided through the central target stand 102 to allow for the insertion of a plurality of target holders 206, to which are secured flexible targets 104, which form the target 150 which creates the visual strike zone 11020 of desired size. For example, target holders 206 may be added or removed (see FIG. 4) as desired by simply sliding the target holders 206 and accompanying flexible targets 104 in or out of the bore holes 304 to change the height of the strike zone 11020 to correspond to the size batter the pitcher may face. Furthermore, flexible targets 104 and/or target holders 206 of different lengths may be provided so that a user can easily change the width of the visual strike zone 11020. For example, the lower target holder 206 and flexible target 104L shown in FIG. 2 may be a predetermined distance from the ground to represent the bottom of the visual strike zone 11020 for a predetermined height of one size batter. As shown in FIG. 4, the lower target holder 206 with flexible target 104L may be removed and additional target holders 206 and flexible targets 104 added to the top to define a visual strike zone 11020 having a predetermined height for a taller batter.

The bore holes 304 may be provided in a line perpendicular to the central target stand's 102 axis, to a predetermined diameter along a predetermined length of the central target stand 102. A lower portion of the central target stand 102 need not have bore holes 304 because the area, between the bottom of the visual strike zone 11020 and the ground is not considered an area toward which to pitch. Therefore, there is no reason to drill bore holes 304, into which to insert target holders 206, over that area of the central target stand 102. The end of the central target stand 102, where there are no bore holes 304, is the end that is inserted into the crossbar 108. The holes that have been drilled are used to secure target holders 206. The target holder 206 may also be made of a predetermined length and diameter of PVC pipe. However, it may be of a smaller diameter than the central target stand 102 so that it can be inserted into the bore holes 304. The target holders 206 are inserted into each hole that has been drilled and are maneuvered so the middle of the length of pipe used for the target holder 206 is aligned with the axis of the central target stand 102.

When the target holder 206 is positioned thusly, a flexible target 104 can be slid onto each side of the target holder 206. In the exemplary embodiment shown in FIG. 1*b*, the flexible targets 104 may be flexible foam in the shape of an open-ended cylinder/sleeve that can be slid over the target holders 206. As shown in FIGS. 1*b* and 3, the target holders 206 are generally circular in cross section. The inner diameter of the flexible targets 104 may be sized with respect to the outer diameter of the target holders 206 to slide on snugly to the target holder 206 while still allowing the flexible target 104 to slide along the target holder 206 to form the size visual strike zone 11020 desired. The flexible targets 104 in this embodiment are made of a flexible and resilient polyethylene foam, cut to a predetermined length and having a hole in their center to allow the target holder 206 to be inserted in them. The flexible targets 104 will bend and flex when hit by a pitch and then return to their original shape and position. Once inserted on the target holder 206, the flexible target 104 can be moved along the target holder 206 to make the overall length of each target 150 longer or shorter, thereby adjusting the width of the visual strike zone 11020. One or more target holder 206 and attached flexible targets 104 can be completely removed or added at will in order to adjust the height of the visual strike zone 11020 to more closely resemble the size strike zone the pitcher may face in the next game. Thus, the adjustable pitching target 100 can be adjusted to change the size of the visual strike zone 11020 both vertically and horizontally.

Operation

The manner of using the adjustable pitching target 100 involves the flexible targets 104 being used to allow the ball that is thrown to maintain its course and also provide a visual indication where the ball passed through the visual strike zone 11020. The flexible targets 104 are then ready for the next pitch. Due to the spacing of the bore holes 304 along the central target stand 102, the flexible targets 104 are positioned so that a baseball, whiffle ball, tennis ball or a softball may be used effectively. This adjustable pitching target 100 will indicate which pitches hit the visual strike zone 11020 so the pitcher learns to locate pitches strategically.

The pitcher may simply place the adjustable pitching target 100 a predetermined distance from where the pitcher will be throwing, such as the distance from home plate to the pitcher's mound in an actual game. Flexible targets 104 can be completely removed or added at will in order to adjust the height of the visual strike zone 11020 to more closely resemble the size strike zone the pitcher may face in the next game. The pitcher assumes his position and throws the ball at the adjustable pitching target 100 to see if he can hit the desired area. If the pitched ball does impact the desired area, the flexible targets 104 of that area flap to indicate where the pitch hit in the visual strike zone 11020. The flexible targets 104 may be colored with paint, tape or in some other manner to more easily mark the desired area and make it easy to identify.

The central target stand 102 acts as an instructor to remind the pitcher to avoid throwing pitches right down the center of the plate. The pitcher will be more effective if he can learn to pitch the ball to the edges of the plate. If a pitched ball misses the visual strike zone 11020, the targets do not move. Therefore, that pitch was a "ball". If a pitched ball hits the visual strike zone 11020, the flexible targets 104 of the area hit flap to indicate where the ball passed through the visual strike zone 11020. If the pitcher locates the pitch right down the center of the visual strike zone 11020, the ball will bounce off the central target stand 102 with a dull thud and fall to the ground.

Figure 5:
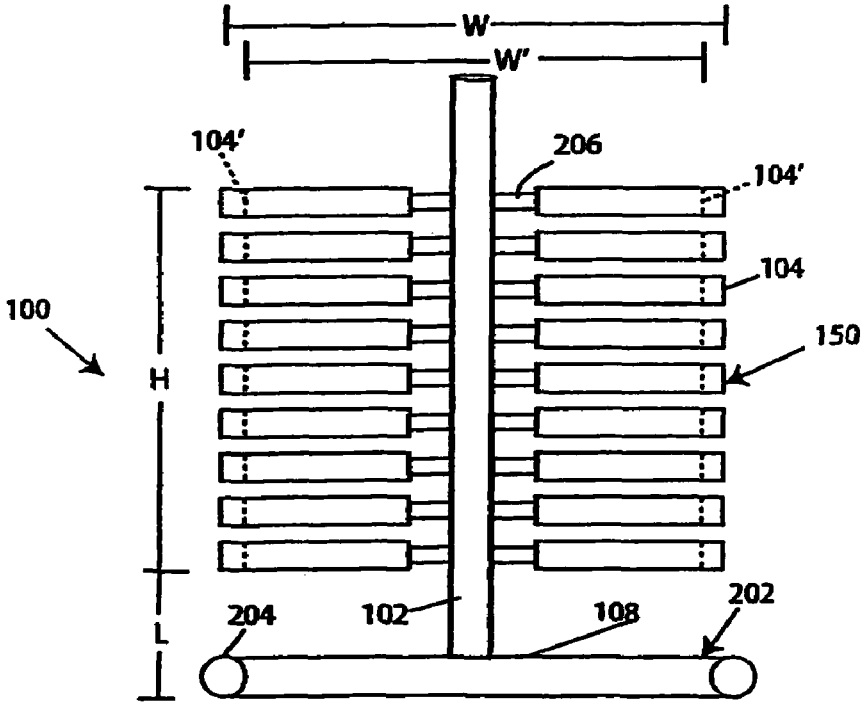
FIG. 5 shows a perspective view of an adjustable pitching target with changes in the height (H) and width (W) of the strike zone, due to removal of upper targets and addition of lower target and adjusting the flexible targets on the target holder, detailed.

One advantage of the present invention is that it can be easily adjusted so that the visual strike zone 11020 can be made to the size the pitcher will most likely be facing. For example, the flexible targets 104 can be extended along the target holder 206 (shown in dashed lines in FIGS. 1*a* and 5) to make the visual strike zone 11020 wider and easier to hit. As the pitcher becomes better able to hit the desired locations, the flexible targets 104 can be moved back in toward the central target stand 102 along the target holder 206, thus making the targets 150 shorter, therefore making the visual strike zone 11020 more narrow and difficult to hit. The ball will pass through the flexible targets 104, due to the spacing of the targets 150, so the pitcher can see exactly where the pitch would go.

The adjustable pitching target 100 is self-supported, it can also be used as an "umpire" during batting practice due to the visual feedback when a pitch hits the flexible targets 104. This adjustable pitching target 100 is fully adjustable to accommodate most any size strike zone that may be encountered by young players. The flexible targets 104 may be colored with paint, tape or in some other manner to more easily mark the desired area and make it easy to identify primary and secondary pitch locations. The adjustable pitching target 100 is light enough to be transported to virtually any location where it is desired for practice to take place.

The adjustable pitching target 100 provides several advantages, such as:

(a) the spacing of the flexible targets 104 allows the pitched ball to maintain its path and pass through the targets 150 as the flexible targets 104 indicate where the ball passed.

(b) the spacing of the targets 150 allows various balls to be used effectively with this apparatus (c) the flexible targets 104 are easy to mark, paint or otherwise color so that strategic portions of the visual strike zone 11020 can be marked to see if the pitcher can hit them when called upon to do so.

(d) the removeable target holders 206 and moveable flexible targets 104 allow the height and width of the strike zone to be adjusted easily and quickly.

(e) since it is self-supported, this adjustable pitching target 100 can also be used as an "umpire" during batting practice due to the visual feedback.

(f) this adjustable pitching target 100 is light enough and can be dismantled easily to be transported to virtually any location desired.

(g) the central target stand 102 acts as an instructor to remind the pitcher to avoid throwing pitches down the middle of the plate.

Accordingly, the reader will see that the adjustable pitching target 100 of the various embodiments can be used in various ways to help pitchers improve the strategic location of their pitches, while still allowing the pitcher to see the flight of the pitch thrown and where it hits in the visual strike zone 11020. In addition, it can be used as an umpire for batting practice to improve a batter's knowledge regarding the location of the pitch they just chose to, or not to, swing at. Although the descriptions above contain many details, they should not be viewed as limiting the scope of the embodiment but as providing illustrations of some of the presently preferred embodiments. For example, the adjustable pitching target 100 can be made larger, constructed from other materials to accommodate what is available, lighter, stronger, a different color or whatever may suit that present need. Thus, the scope of the embodiment should be determined by the appended claims and their legal equivalents, rather than by examples given.

I claim:

1. A method of training a pitcher to throw a ball to a desired location comprising:

A) Providing a target apparatus consisting of a base adapted for placement on a surface;

a central target stand removeably coupled to the base, said central target stand upward from the base; a plurality of target holders removeably coupled to the central target stand, said target holders extending horizontally, a first side of the target stand and a second side of the target stand and a plurality of resilient, flexible targets removeably coupled to target holders, said resilient, flexible targets defining a strike zone to which a pitcher throws a ball and react when hit by a pitch thrown from the pitcher to indicate the location of the pitch in the strike zone and wherein said targets after being hit by said ball returns to it's original shape;

B) Providing a ball for throwing at said target apparatus;

C) Instructing the user in how to use the target apparatus to improve the user's ability to throw said ball to the desired location wherein when the ball is thrown and strikes a target area, the flexible targets for that area move to provide a visual indicator to the user of the location of the pitch and said target returns to its original shape and position.

2. The method of training as claimed in claim 1 wherein the flexible targets are made of a polyethylene foam and are positioned on the right and left sides of the central target stand to reinforce to the pitcher that he should throw pitches to the edges of the strike zone.

* * * * *